United States Patent [19]

Frank et al.

[11] 3,969,741

[45] July 13, 1976

[54] APPARATUS FOR PRODUCING A DEVELOPER MEDIUM FOR DIAZOTYPE MATERIALS

[75] Inventors: Hermann Frank, Sulzbach; Karl-Heinz Degenhardt, Bad Schwalbach, both of Germany

[73] Assignee: Hoechst Aktiengesellschaft, Germany

[22] Filed: Sept. 7, 1973

[21] Appl. No.: 395,152

[30] Foreign Application Priority Data

Sept. 9, 1972 Germany ..... 2244384

[52] U.S. Cl. ..... 354/299; 23/282; 219/271; 219/272; 354/300

[51] Int. Cl.[2] ..... G03D 13/00; G03D 7/00

[58] Field of Search ..... 354/297, 299, 300, 324; 23/282; 34/36, 145, 155; 219/271, 272, 275; 202/153, 234

[56] References Cited

UNITED STATES PATENTS

| | | | |
|---|---|---|---|
| 631,461 | 8/1899 | Guillaume | 202/153 X |
| 2,096,015 | 10/1937 | Von Meister et al. | 354/300 X |
| 2,108,914 | 2/1938 | Bennett | 202/234 X |
| 2,522,529 | 9/1950 | Miller et al. | 219/275 UX |
| 2,696,771 | 12/1954 | Frantz | 354/300 X |
| 3,147,687 | 9/1964 | Halden | 354/300 X |

FOREIGN PATENTS OR APPLICATIONS

| | | | |
|---|---|---|---|
| 679,771 | 9/1952 | United Kingdom | 354/300 |

*Primary Examiner*—Fred L. Braun
*Attorney, Agent, or Firm*—James E. Bryan

[57] ABSTRACT

An apparatus for producing a gaseous developer medium for diazo-type material having a distillation column through which fluid developer solution and vapor pass counter-currently. An outlet on the distillation column is connected to a developing chamber. An inlet on the distillation column serves for feeding developer solution therein. The apparatus further includes a vapor generator connected to the distillation column by a direct conduit.

11 Claims, 3 Drawing Figures

1
2
3
4
5
6
7
8
9
10
11
12
13
14
15
16
17
18

APPARATUS FOR PRODUCING A DEVELOPER MEDIUM FOR DIAZOTYPE MATERIALS

This invention relates to a process and apparatus for vaporizing, from a developer solution, a developer medium for use in a developing apparatus for diazotype materials. More particularly, the invention relates to the production of an ammonia gas/water vapor mixture from an aqueous ammonia solution. Other developer solutions, however, also can be used according to the invention.

In the developing apparatuses previously proposed for diazotype materials, an ammonia gas/water vapor mixture is generated, for example, by feeding aqueous ammonia dropwise into a dish in the developing chamber and vaporizing it by heating the dish (German Auslegeschrift No. 1,097,816). Instead of a dish, it is possible to use as the vaporizer a vaporization channel which is provided at one end with an inlet and at the other end with an outlet for the developer solution (aqueous ammonia) (German Pat. No. 860,138). Furthermore, vaporizers also have been proposed which are constructed as a tube having a heating rod or the like therein. The tube is provided with slots or holes through which the developing gas can issue into the developing chamber (German Auslegeschriften Nos. 1,096,198 and 1,098,362). In these previously proposed vaporizers, either the entire aqueous ammonia (added dropwise), or only a part thereof, is vaporized. In the former case, the developer gas obtained generally contains too much water vapor, since in most cases aqueous ammonia of 25 to 30% concentration is employed. In the second case, where only a part of the developer solution is vaporized, the developer gas has a more favorable composition, the composition depending essentially on the initial concentration of the aqueous ammonia and on the temperature prevailing in the vaporizer, but the aqueous ammonia is utilized relatively poorly, that is to say the residual water leaving the vaporizer still contains a rather high percentage of ammonia. This residual water cannot be passed directly into the sewer because of its relatively high ammonia content (about 5 to 10% concentration).

The water vapor generated together with the ammonia gas in the above-mentioned processes accelerates the developing process. On the parts of the developing chamber which are at a temperature below that of the vaporizer, however, the water vapor re-condenses and the condensate redissolves some of the ammonia present in the developing chamber; because its temperature is lower than that in the vaporizer, this condensate dissolves a rather large amount of ammonia. The condensate, which collects as a so-called sump in the developing chamber, must be discharged from the developing chamber, and is too concentrated to be directly dischargeable into the sewer.

The present invention provides a process for producing from a developer solution a gaseous developer medium for diazotype materials, which process comprises causing a stream of the developer solution flowing in one general direction to come into intimate contact with a stream of vapor flowing in the opposite general direction so that exchange of materials takes place between the vapor and the developer solution. The process is preferably carried out continuously, that is according to the principle of continuous distillation.

In the process according to the invention, the developer solution is passed counter-currently to a stream of vapor with intimate contact of the two phases according to the principle of continuous distillation, in the course of which material exchange takes place between the developer solution and the vapor, said gaseous developer medium being recovered thereby as a product of the process.

The invention also provides apparatus for producing a gaseous developer medium for diazotype materials from a developer solution, which apparatus comprises a distillation flask for generating a stream of vapor, which flask is provided with a heater and an outlet for the residual water and an adjacent distillation column being provided at, or in the region of, its head with an inlet for the developer solution and an outlet for the developer medium, the outlet communicating with a developing chamber for diazotype materials.

In contrast to the previously proposed vaporizers described above, which all work on the principle of one-step distillation, the process and apparatus of the invention make it possible to obtain an optimum developer gas composition and, at the same time, optimum utilization of the developer solution; almost the entire developer medium contained in the developer solution may be liberated and the residual water issuing at the outlet of the distillation flask will normally contain an extremely low concentration of developer medium. At the same time it is possible to easily adapt the output of the vaporizer to the particular amounts of developer gas required and to maintain the developer gas composition constant whatever the amount of developer gas produced.

The process and apparatus of the invention are particularly useful for producing a developer medium which comprises an ammonia-water mixture, the developer solution in this case comprising aqueous ammonia and, in the following description, the invention is generally described with reference to such a developer medium. It will be appreciated, however, that most of the features of the process and apparatus of the invention described below are equally applicable to other developer media.

The process of the invention operates on the principle of continuous distillation, wherein a descending stream of liquid comes into contact with an ascending stream of vapor. When developing with ammonia, the developer medium is, as already mentioned above, an ammonia gas/water vapor mixture. It is thus not necessary to separate the aqueous ammonia (the developer solution) into ammonia gas and the higher-boiling water; instead, the developer solution should be separated into an ammonia gas/water vapor mixture of optimum composition for the developement of diazotype materials and so-called residual water which retains only minimal amounts of ammonia. Using the vaporizer according to the invention, it is possible to reduce the ammonia content of this residual water to as little as 100 ppm or less.

In the process according to the invention, this optimum separation is achieved by passing the aqueous ammonia as a stream of liquid counter-currently to a stream of vapor with intimate contact of the two phases, according to the principle of continuous distillation, whereupon material exchange takes place between the vapor and the developer solution. The term continuous distillation is to be understood to mean that aqueous ammonia can be constantly introduced while water which is almost free of ammonia can run off continuously, and developer gas is liberated continuously.

The vaporizer according to the invention can be located within or outside the developing chamber. Arguments in favor of location outside the developing chamber are easy accessibility and hence simpler servicing of the vaporizer. For thermal and technological reasons, however, it may be advantageous to locate the vaporizer partially or entirely in the developing chamber. It is also possible to integrate the developing chamber, in which the developer gas (the ammonia gas/water vapor mixture) acts on the diazotype material, into the apparatus of the invention. Thus, for example, the outlet for the gaseous developer medium can be so designed that the transport of the diazotype material can take place therethrough. The entire apparatus would in that case be approximately as broad as a developing chamber.

The vaporizer, which consists of a distillation flask and an distillation column, has an outlet, on the distillation flask, for the residual water. This outlet can be in the form of a syphon in order to provide a gas-tight seal from the exterior. The developer solution may be introduced directly at the column head or in the vicinity of the column head. If the inlet for the developer solution is located at the column head and if the outlet for the gaseous developer medium (the ammonia gas/water vapor mixture) is somewhat below the column head, the developer solution initially passes through a short pre-warming zone. However, the developer solution also can be pre-warmed before it is introduced into the vaporizer.

The composition of the developer gas (the ammonia gas/water vapor mixture) depends on the temperature prevailing at the column head. It is therefore desirable to provide, at the column head, a thermometer by means of which the temperature can be monitored, and to adjust the heating of the distillation flask in accordance with the desired temperature. In a preferred embodiment, a temperature probe and a temperature regulator, which automatically regulates the heating of the distillation apparatus, is provided at the developer gas outlet.

Different amounts of developer gas per unit time are frequently required for developing. The amount of developer gas generated per unit time in the vaporizer, that is to say the output of the vaporizer, can be regulated by different rates of introduction of developer solution, for example by means of a valve. This introduction can be regulated by means of a suitable control system in a manner which is in itself known.

The distillation column of the vaporizer can be either a column with stepwise separation and fixed inserts, or can be a continuously separating packed column. Examples of fixed column inserts are bubble plates, valve plates, and perforated plates, while examples of packings which can be used for packed columns are rings, saddles, stars, tetrapods, and fibers. These packings can, if desired, be combined with fixed inserts in order to achieve improved flow of the stream of liquid and, if appropriate, to provide a support for the packings.

As already has been mentioned above, developer gas tends to condense on the colder parts of the developing chamber. In order to avoid a sump forming in the developing chamber, this condensate can be returned into the vaporizer of the invention by introducing it at the column head or in the vicinity of the column head through a separate inlet, through the outlet of the developer gas, or through the inlet for the developer solution.

The condensate supplied to the vaporizer increases the amount of liquid flowing through the vaporizer. The amount of liquid can be further increased by the distillation column being only partially heat-insulated or not heat-insulated at all so that condensate also forms at the parts of the column jacket which are not heat-insulated.

The reflux can be additionally intensified by connecting a condenser to the outlet for the gaseous medium, the condenser, viewed in the flow direction of the gaseous developer medium, being mounted between the outlet means for the gaseous developer medium and a developing chamber for diazotype materials, whereby part of the developer gas is condensed for refluxing.

The distillation column can be mounted vertically on the distillation flask or can be attached to the flask at an angle. This angled arrangement can be particularly advantageous if the descending stream of liquid does not originate only from the partially condensed developer gas and the developer solution introduced through the inlet, but is also fed by condensate which forms along the cooler part of the column jacket which is not heat-insulated.

The invention will now be described, by way of example only, with reference to the accompanying drawings, in which.

Figures 1, 2:
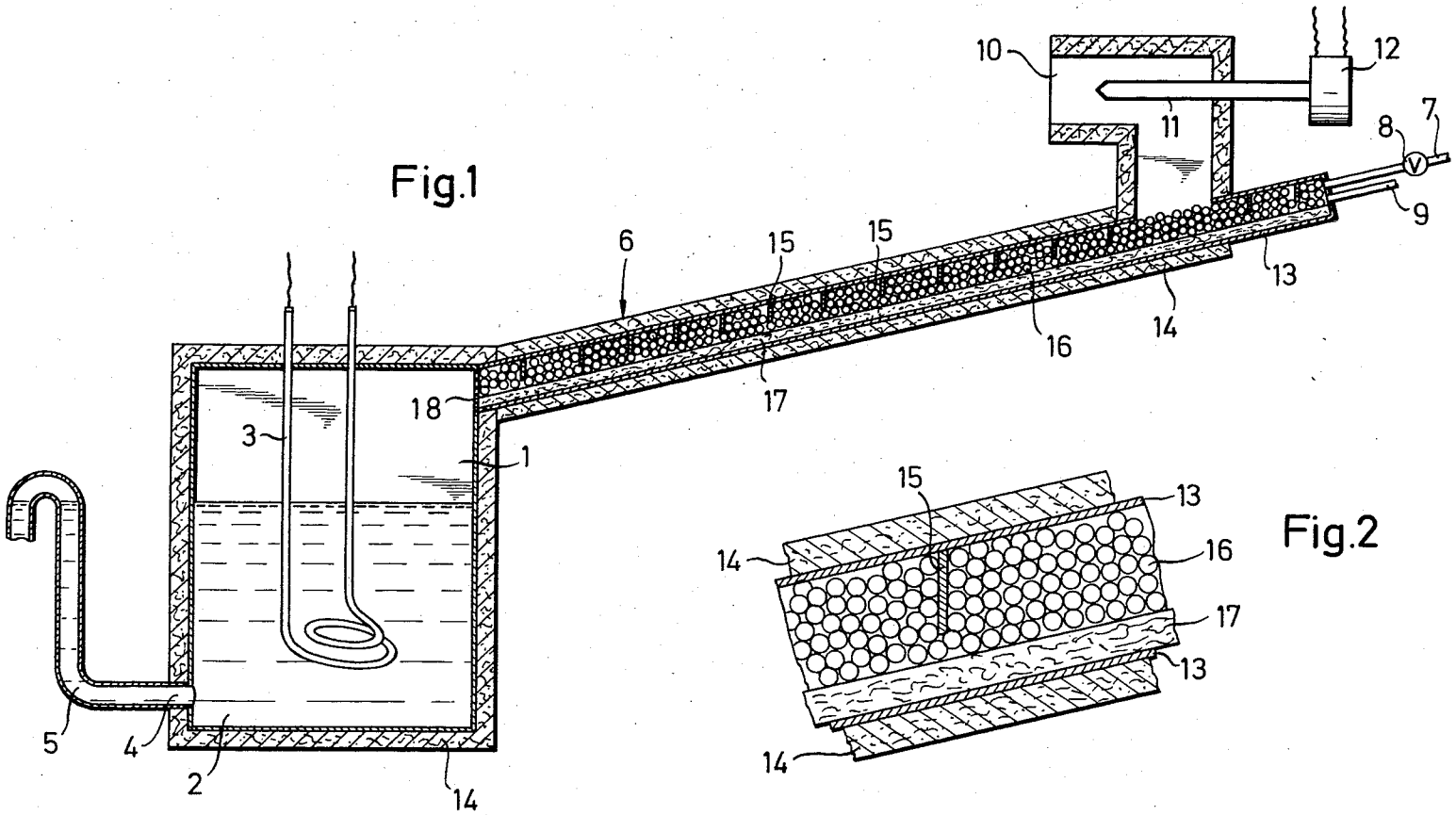
FIG. 1 shows a cross-section through a first device in accordance with the invention.
FIG. 2 shows an enlarged section of the distillation column shown in FIG. 1.

Referring now to the drawings, FIG. 1 shows a distillation flask 1, in which water 2 which is practically free of ammonia is present as a so-called sump. The water can be vaporized by means of an immersion heater 3 and an ascending stream of vapor is thus produced. The distillation flask 1 is provided with an overflow 4 for the water, this overflow preferably being constructed as a syphon 5 in order to produce a gas-tight seal between the distillation flask 1 and the exterior. The distillation flask 1 communicates with an distillation column 6 which is provided with a jacket 13. An inlet 7 for aqueous ammonia is located at the head of the column 6, and the amount of aqueous ammonia introduced per unit time into the column 6 can be regulated by means of a metering device (valve) 8 on the inlet 7. At the head of the distillation column 6 there is also an inlet 9 for the condensate of the developer gas which has been produced on the colder parts of the developing chamber. An outlet 10 for the developer gas liberated is provided somewhat below the column head. The immersion heater 3 in the distillation flask 1 is controlled by means of a temperature probe 11 located in the outlet 10 and a temperature regulator 12. The distillation flask 1, the outlet 10 for the developer gas and a part of the jacket 13 of the distillation column 6 are provided with a layer of insulating material 14 to reduce the heat losses. The distillation column 6 contains fixed inserts 15 which serve to improve the flow of the stream of liquid. Between the inserts 15, the distillation column 6 is filled with packings 16, for example Raschig rings, the packings 16 being supported by the inserts 15. When the distillation column 6 is arranged at an angle, as in FIG. 1, a fleece material 17 is provided on the downward-facing wall of the column 6, in the interior of the distillation column, to reduce the rate of flow of liquid in the column 6. At the lower end of the distillation column 6 there is a perforated plate 18 for holding the packings 16 in the column.

The aqueous ammonia introduced into the vaporizer at the column head through the inlet 7 and the condensate introduced via the second inlet 9 flow over the packings 16 counter-currently to the ascending stream of water vapor generated in the distillation flask 1 by means of the immersion heater 3; this water vapor is, of course, initially almost pure. In the course of this counter-current flow, a part of the aqueous ammonia or condensate is vaporized, the concentration of the lower-boiling ammonia being substantially higher in the developer gas than in the aqueous ammonia which has not been vaporized, and which continues to flow downwards. The ammonia/water vapor mixture flows through the outlet 10 into the developing chamber (not shown). Vapor is condensed in accordance with the amount of heat required to liberate the developer gas from the aqueous ammonia. The condensate produced, together with the aqueous ammonia which has not been vaporized, continues to flow downwards in the distillation column 6 counter-currently to the water vapor ascending from the distillation flask 1. In the course of this downwards flow, a condensate enriched in water and a vapor enriched with ammonia are formed in accordance with the heat exchange between the two phases. From the distillation flask 1 to the column head the stream of vapor shows progressive enrichment in ammonia while in the opposite direction the condensate shows progressive depletion of ammonia so that the water present in the distillation flask 1 retains hardly any ammonia. With five to six theoretical plates in the distillation column, a residual water with an ammonia content of, for example 100 ppm may be obtained at the outlet 4.

In an distillation column with more plates is used, the ammonia content can be reduced to below 100 ppm.

FIG. 2 shows in greater detail the column jacket 13, insulation 14, fixed inserts 15, packings 16 and fleece material 17 of the distillation column 6.

Figure 3:
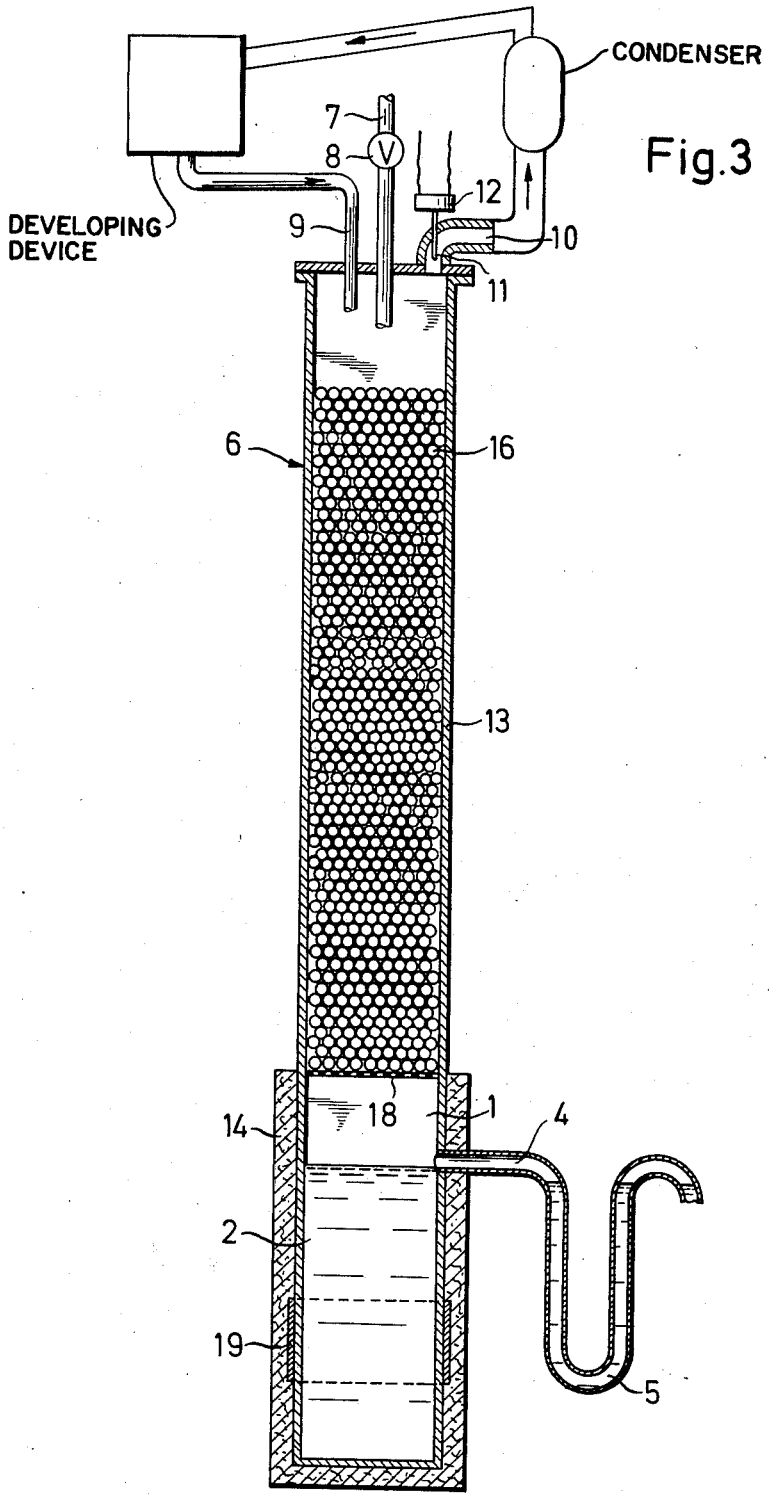
FIG. 3 shows a cross-section through a second device constructed in accordance with the invention.

In the embodiment of the invention shown in FIG. 3, the distillation column 6 is mounted vertically on the distillation flask 1. In this embodiment, the inlet 7 for the aqueous ammonia, the inlet 9 for the condensate from the developing chamber and the outlet 10 for the ammonia gas/water vapor mixture are located on the column head. The distillation column 6 does not contain any fixed inserts but contains only packings 16, for example saddles, which are stacked up on the perforated plates 18. The distillation flask 1 is heated by means of a ring heater 19.

It will be obvious to those skilled in the art that many modifications may be made within the scope of the present invention without departing from the spirit thereof, and the invention includes all such modifications.

What is claimed is:

1. An apparatus for producing a gaseous developer medium for diazotype materials from a developer solution, which comprises vapor-generating means, distillation column means arranged above said vapor-generating means and connected thereto, inlet means on said column means for developer solution to pass counter-currently to vapor from said vapor-generating means, means whereby depleted developer solution flows out of said column means into said vapor-generating means, outlet means on said vapor-generating means for residual water, and outlet means on said column means for said gaseous developer medium.

2. An apparatus according to claim 1 in which the distillation column means are attached to the vapor-generating means at an angle.

3. An apparatus according to claim 1 including condenser means connected to the outlet means for the gaseous developer medium, said condenser means, viewed in flow direction of the gaseous developer medium, being arranged between said outlet means and a developing chamber for diazotype materials.

4. An apparatus according to claim 1 in which the column means has a head at the top thereof, and in which the inlet means for developer solution and the outlet means for the developer medium are in the region of said head.

5. An apparatus according to claim 1 in which the distillation column means is a plate column means.

6. An apparatus according to claim 1 in which the distillation column means is a packed column means.

7. An apparatus according to claim 6 in which the packed column means includes fixed insert means.

8. An apparatus according to claim 1 in which the distillation column means is provided along at least part of the length thereof with a layer of thermally insulating material, said insulating material being absent in the region of the outlet means for said gaseous developer medium.

9. An apparatus according to claim 1 including second inlet means for the introduction of condensate from a developing chamber, said second inlet means being in the vicinity of the inlet means for developer solution.

10. An apparatus according to claim 1 including temperature probe means in the region of the outlet means for gaseous developer medium, and regulating means whereby the temperature in the vapor-generating means can be adjusted to provide a desired temperature to the gaseous developer medium.

11. An apparatus according to claim 1 in which the outlet means on said vapor-generating means comprises a syphon.

* * * * *